US010407818B2

(12) United States Patent
Striato

(10) Patent No.: US 10,407,818 B2
(45) Date of Patent: Sep. 10, 2019

(54) WASHER-DRYER WITH AT LEAST ONE CONDENSER

(71) Applicant: Electrolux Home Products Corporation N.V., Brussels (BE)

(72) Inventor: Daniele Striato, San Vito Al Tagliamento (IT)

(73) Assignee: Electrolux Home Products Corporation N.V., Brussels (BE)

( * ) Notice: Subject to any disclaimer, the term of this patent is extended or adjusted under 35 U.S.C. 154(b) by 667 days.

(21) Appl. No.: 14/345,536

(22) PCT Filed: Sep. 18, 2012

(86) PCT No.: PCT/EP2012/068318
§ 371 (c)(1),
(2) Date: Mar. 18, 2014

(87) PCT Pub. No.: WO2013/041513
PCT Pub. Date: Mar. 28, 2013

(65) Prior Publication Data

US 2014/0338404 A1 Nov. 20, 2014

(30) Foreign Application Priority Data

Sep. 19, 2011 (EP) ..... 11181824

(51) Int. Cl.
*D06F 58/24* (2006.01)
*D06F 58/20* (2006.01)
*D06F 25/00* (2006.01)

(52) U.S. Cl.
CPC ..... *D06F 58/24* (2013.01); *D06F 25/00* (2013.01); *D06F 58/20* (2013.01)

(58) Field of Classification Search
CPC .. D06F 25/00; D06F 58/24; D06F 2058/2832; D06F 43/083; D06F 43/088
See application file for complete search history.

(56) References Cited

U.S. PATENT DOCUMENTS 2,607,209 A * 8/1952 Constantine ..... D06F 25/00 34/131
2004/0117919 A1* 6/2004 Conrad ..... C11D 11/0064 8/137

(Continued)

FOREIGN PATENT DOCUMENTS

EP 0428846 5/1991
EP 0829569 3/1998

(Continued)

OTHER PUBLICATIONS

JPH06063298—Machine Translation, Mar. 1994.*

(Continued)

*Primary Examiner* — Marc Lorenzi
(74) *Attorney, Agent, or Firm* — RatnerPrestia

(57) ABSTRACT

A washer-dryer is provided with at least one condenser for condensing moisture-laden air exiting the laundry during a drying cycle. The washer-dryer includes a washing tub (10) comprising a cylindrical lateral wall (12) and a rear wall (14) and a rotatable laundry drum (24) arranged or arrangeable inside the washing tub (10). An inlet (20) of the condenser is arranged at or connected to the rear wall of the washing tub (10). An outlet of the condenser is connected to the washing tub (10). The rear wall (14) of the washing tub (10) comprises a duct (18) fluidly connected to the inlet (20) of the condenser, so that the air stream from the laundry drum (24) to the inlet (20) of the condenser passes the duct (18). At least one sensor (22) is arranged inside the duct (18).

10 Claims, 3 Drawing Sheets

(56) References Cited

U.S. PATENT DOCUMENTS

| | | | | |
|---|---|---|---|---|
| 2005/0081575 | A1* | 4/2005 | Park | D06F 58/24 68/18 C |
| 2006/0156766 | A1 | 7/2006 | Ioku | |
| 2006/0195989 | A1* | 9/2006 | Jeong | D06F 25/00 8/158 |
| 2007/0033970 | A1* | 2/2007 | Lee | D06F 25/00 68/19.2 |
| 2008/0282750 | A1* | 11/2008 | Yang | D06F 39/008 68/5 C |
| 2009/0056034 | A1* | 3/2009 | Herkle | D06F 39/008 8/149.3 |

FOREIGN PATENT DOCUMENTS

| | | | | |
|---|---|---|---|---|
| EP | 1094141 | | 4/2001 | |
| EP | 1500739 | | 1/2005 | |
| EP | 1526210 | | 4/2005 | |
| EP | 1666655 | | 6/2006 | |
| EP | 2019160 | | 1/2009 | |
| EP | 2019163 | | 1/2009 | |
| EP | 2053157 | A1 * | 4/2009 | D06F 25/00 |
| EP | 2108730 | | 10/2009 | |
| EP | 2570548 | | 3/2013 | |
| GB | 2236334 | | 4/1991 | |
| JP | 06063298 | A * | 3/1994 | |
| JP | 6-98991 | | 4/1994 | |
| JP | 6098991 | | 4/1994 | |
| JP | 747195 | | 2/1995 | |
| JP | 2001-218994 | | 8/2001 | |
| JP | 2001-269495 | | 10/2001 | |
| JP | 2009-254634 | | 11/2009 | |
| JP | 2009297282 | | 12/2009 | |
| KR | 10-2007-0015280 | | 2/2007 | |
| WO | WO2004/044302 | | 5/2005 | |
| WO | 2007/024050 | | 3/2007 | |
| WO | 2007/138019 | | 12/2007 | |
| WO | WO2007/138019 | | 12/2007 | |
| WO | WO2010060781 | | 6/2010 | |
| WO | WO-2010100111 | A1 * | 9/2010 | D06F 39/003 |

OTHER PUBLICATIONS

Extended European Search Report dated May 15, 2012 in corresponding European Application No. 11181824.1.

International Search Report dated Oct. 18, 2012 in corresponding International Application No. PCT/EP2012/068318.

BSH Home Appliances LTD invoice dated Aug. 17, 2011, 1 page.

Photos, Aug. 17, 2011, 11pages.

European Patent Office Communication for EP Application No. 12759465.3, dated Nov. 17, 2017.

Chinese Office Action for Chinese Application No. 201710618829.1, dated May 7, 2019 with translation, 14 pages. 2019.

* cited by examiner

WASHER-DRYER WITH AT LEAST ONE CONDENSER

BACKGROUND

The present invention relates to a washer-dryer with at least one condenser for condensing the moisture-laden air exiting the laundry during the drying cycle. Advantageously, the condenser and the rear wall of the washer-dryer are formed as a single-piece part.

A typical washer-dryer includes an automatic control system, wherein the humidity of the laundry has to be determined. One or more sensors are arranged for detecting at least one specific parameter of the air stream flowing through the drying cycle. However, if the sensor is not able to detect variations of said parameter, then the performance of the automatic control system and of the washer-dryer is reduced.

WO 2007/138019 A1 discloses a washer-dryer comprising a temperature detection unit placed inside the washing tub.

JP 7-47195 A discloses a washer-dryer with two temperature sensors. One temperature sensor is arranged in the washing tub. The other temperature sensor is placed in a hot air conduit.

GB 2 236 334 A discloses a washer-dryer provided with an NTC element in the washing tub for detecting the temperature of the water. A further thermostat is provided for regulating the temperature of the air stream.

EP 1 526 210 B1 discloses a washing machine control method using two temperature sensors. One temperature sensor is placed in the washing tub. The other temperature sensor is arranged in the air conduit for controlling the drying cycle.

SUMMARY OF SELECTED INVENTIVE ASPECTS

It is an object of the present invention to provide an improved washer-dryer with at least one condenser, wherein said washer-dryer allows a reliable detection of parameters in order to determine the humidity of the laundry.

According to an aspect of the present invention the rear wall of the washing tub comprises a duct which is fluidly connected to the inlet of the condenser, so that the air stream from the laundry drum to the inlet of the condenser passes the duct, and at least one sensor is arranged inside the duct.

Advantageously the duct may be formed by an embossed area, or by a hollow or sunken area.

A main idea of the present invention is the duct in the rear wall of the washing tub, advantageously facing the laundry drum, on the one hand, and the sensor inside said duct on the other hand. Almost all of the air stream from the laundry drum to the inlet of the condenser passes the duct and the sensor. This improves the performance of the washer-dryer during the drying cycle. Moreover this particular positioning of the sensor ensures that most of the air exiting the drum comes in contact with the sensor before entering the condenser, with the effect of ensuring that the sensor effectively detects the temperature of the air stream.

For example, at least one temperature sensor is arranged inside the duct. Advantageously, at least one temperature sensor is arranged in proximity of the inlet of the condenser.

Additionally, at least one further temperature sensor is arranged in proximity of a heater. The combination of both sensors allows an improved determination of the humidity of the laundry.

Further, a partition wall, a septum and/or a bulkhead is provided in the duct in order to protect the sensor from water drops. Preferably, the partition wall, the septum and/or the bulkhead extends along the whole length of the duct.

Advantageously the partition wall, septum and/or bulkhead is made in a single piece construction with the rear wall of the tub.

Opportunely, the partition wall, septum and/or bulkhead subdivides the duct in a lower region and in an upper region containing the sensor.

Advantageously, the washing tub comprises a sump in its lowermost position. In this case, the duct extends from the sump to the inlet of the condenser. Advantageously, a cylindrical curved wall of the laundry drum is perforated, so that the air stream from the laundry drum passes the sump of the washing tub.

Preferably, the condenser and the rear wall of the washing tub are formed as a single body. In this case, the condenser and the rear wall of the washing tub may be formed as a single-piece part.

BRIEF DESCRIPTION OF THE DRAWINGS

The invention will be described in further detail with reference to the drawings, in which.

DETAILED DESCRIPTION OF EXAMPLE EMBODIMENTS

Figure 1:
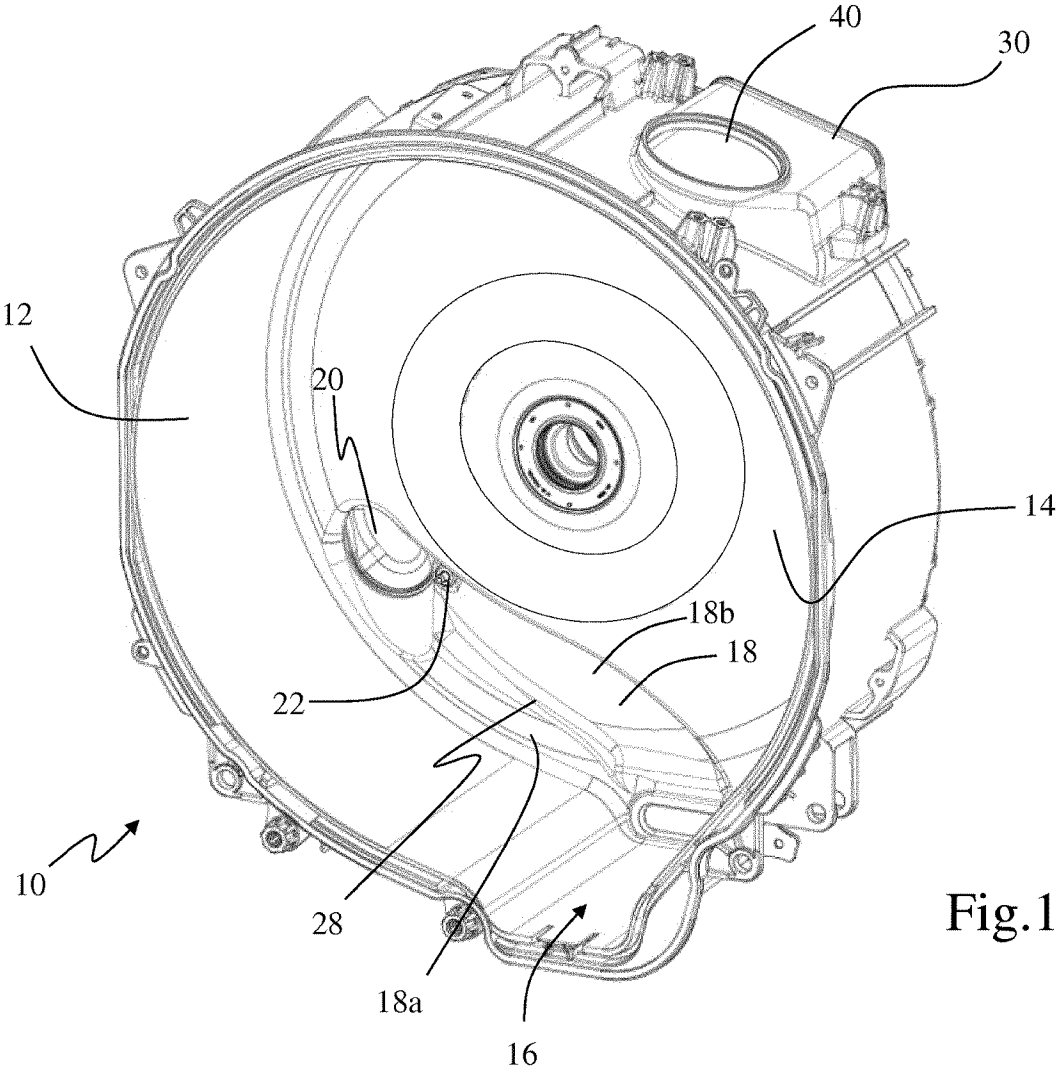
FIG. 1 shows a schematic perspective view of a washing tub for a washer-dryer according to a preferred embodiment of the present invention.

FIG. 1 illustrates a schematic perspective view of a washing tub 10 for a washer-dryer according to a preferred embodiment of the present invention. The washing tub 10 is provided for receiving a laundry drum 24, which is not shown in FIG. 1. Said laundry drum 24 is rotatable inside the washing tub 10.

The washing tub 10 includes a cylindrical lateral wall 12 and a preferably substantially plane or hemispherical rear wall 14. The cylindrical lateral wall 12 comprises a sump 16 in its lowermost position. The rear wall 14 comprises a duct 18 in its lower portion.

Advantageously, as illustrated in enclosed figures, duct 18 may be formed by a hollow or sunken area (in enclosed figures coinciding with the duct 18), obtained in the rear wall 14; in the embodiment illustrated in enclosed figures, this hollow or sunken area 18 extends between the sump 16 and an inlet 20 of a condenser 30 and therefore is fluidly connected to the inlet 20 of the condenser.

In a further embodiment, duct 18 may be formed by an embossed area extending between the sump 16 and an inlet 20 of a condenser 30 and therefore fluidly connected to the inlet 20 of the condenser.

Figure 3:
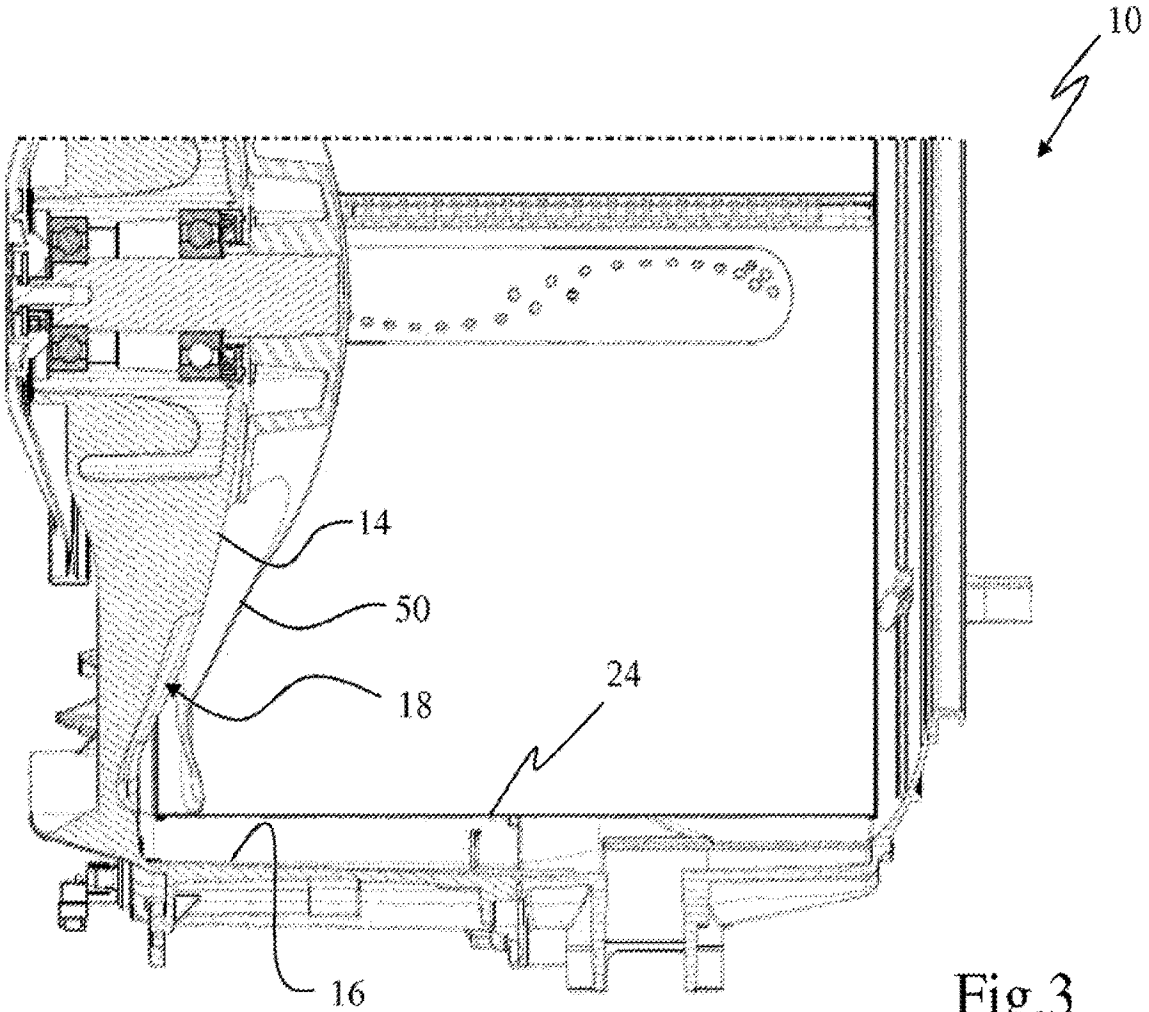
FIG. 3 shows a partial sectional side view of the washing tub for the washer-dryer according to the preferred embodiment of the present invention.

Advantageously, as for example illustrated in FIG. 3, the duct 18 faces a rear wall 50 of the laundry drum 24. The duct is provided for an air stream from the laundry drum 24 via the sump 16 to the inlet 20 of the condenser 30. For example, the cylindrical curved wall of the laundry drum 24 is perforated, so that the air stream can leave said laundry drum 24 above the sump 16 of the washing tub 10.

Figure 2:
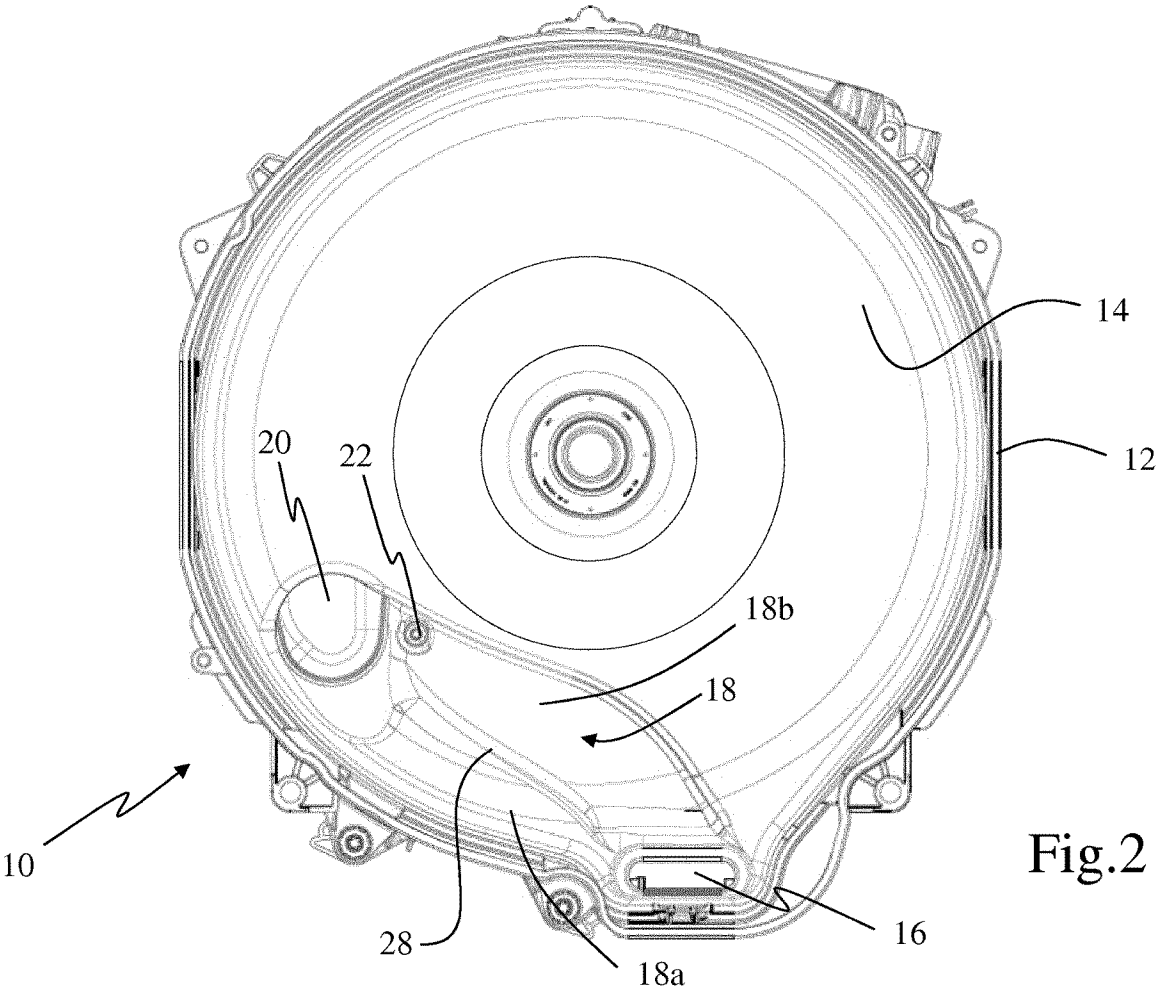
FIG. 2 shows a schematic front view of the washing tub for the washer-dryer according to the preferred embodiment of the present invention.

As for example illustrated in FIGS. 1 and 2, at least one sensor 22 is arranged inside the duct. The sensor 22 is provided for detecting the humidity and/or the temperature of the air stream from the laundry drum 24 to the inlet 20 of the condenser. In this example, the sensor is a temperature sensor 22.

FIG. 2 shows a schematic front view of the washing tub 10 for the washer-dryer according to the preferred embodiment of the present invention.

The washing tub 10 includes the cylindrical lateral wall 12 and the rear wall 14. The rear wall 14 is preferably substantially formed as a circular disk. The sump 16 is in the lowermost position of the cylindrical lateral wall 12. The duct 18 preferably extends between the sump 16 and the inlet 20 of the condenser. The duct faces the rear wall 50 of the laundry drum 24. The temperature sensor 22 is arranged inside the duct.

FIG. 3 shows a partial sectional side view of the washing tub 10 for the washer-dryer according to the preferred embodiment of the present invention. The laundry drum 24 is arranged inside the washing tub 10. A heater, not illustrated, is placed in the sump 16, so as to be able to heat the washing water collected therein. The duct 18 and faces the rear wall 50 of the laundry drum 24.

Preferably, the condenser 30 and the rear wall 14 of the washing tub 10 form a single body or a single-piece part. However, the condenser 30 may be also formed as a separate part and connected to the washing tub 10 by its inlet 20 and its outlet 40.

The duct 18 facing the rear wall 50 of the laundry drum 24 allows that the hot and moisture-laden air stream exiting the drum 24 is directed from the laundry drum 24 towards the inlet 20 of the condenser 30. This duct ensures that substantially the whole air stream exiting the drum is admitted into the inlet 20 of the condenser. This improves the overall performances of the washer-dryer during the drying phase.

Moreover, the duct has the effect of improving the air circulation in the washer-dryer. Further, the duct reduces the turbulence of the air stream. The reduced turbulence of the air stream decrease the noise and also the time required for drying the laundry.

The sensor 22 is placed inside the duct and in proximity of the inlet 20 of the condenser 30. For example, the sensor 22 is a temperature sensor. The temperature sensor 22 in this position has the effect that the temperature of the air stream is detected at a meaningful position of the air stream cycle, where the hot and moisture-laden air stream exits the laundry drum 24, since substantially the whole or entire air stream passes in the duct. Thus, substantially the total air stream contacts the sensor 22.

Preferably, the temperature sensor 22 operates together with a further temperature sensor arranged in proximity of or in correspondence of the heater, not illustrated, placed in the sump 16. For example, the drying cycle is controlled by activating or deactivating an air heater. Further, the drying cycle may be controlled by stopping the drying cycle. The control of the drying cycle depends on the temperatures detected by the temperature sensors. Preferably, the control of the drying cycle depends on the difference of the detected temperatures.

A partition wall, septum and/or bulkhead 28 may be provided in the duct. Preferably the partition wall, septum and/or bulkhead is made in a single piece construction with the rear wall 14 of the tub 10. The partition wall, septum and/or bulkhead 28 have the effect of protecting the temperature sensor 22 placed in the duct from drops of water present in the bottom of the washing tub. For example, condensed water comes out from the condenser 30 or water remained in the bottom of the washing tub, e.g. from a previous washing cycle. These drops of water could compromise the temperature detection of the sensor. Preferably the partition wall is obtained along the whole length of the duct (i.e. from the sump 16 to the inlet 20 of the condenser 30).

Advantageously the partition wall, septum and/or bulkhead 28 subdivides the duct in a lower region 18*a* and in an upper region 18*b*, containing the sensor 22.

Although an illustrative embodiment of the present invention has been described herein with reference to the accompanying drawings, it is to be understood that the present invention is not limited to this precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 washing tub
12 lateral wall
14 rear wall
16 sump
18 duct
18*a* lower region
18*b* upper region
20 inlet of the condenser
22 sensor, temperature sensor
24 laundry drum
28 partition wall, septum and/or bulkhead
30 condenser
40 outlet of the condenser
50 rear wall of the drum

The invention claimed is:

1. A washer-dryer comprising:

a washing tub comprising a rear wall and a cylindrical lateral wall extending from an outer perimeter of the rear wall in a first direction, a rotatable laundry drum arranged inside the washing tub, a condenser for condensing moisture-laden air exiting laundry during a drying cycle, the condenser including a condenser inlet arranged at or connected to the rear wall of the washing tub, and a condenser outlet connected to the washing tub;

a duct provided in the rear wall of the washing tub, the duct comprising a hollow or sunken area of the rear wall of the washing tub having an open front side facing a rear wall of the laundry drum with the open front side extending from a sump at a bottom of the washing tub to the condenser inlet, and the duct being configured to direct an air stream from the laundry drum through said duct from the sump to the condenser inlet; and at least one temperature sensor arranged in the duct in a position to detect the temperature of the air stream exiting the laundry drum before the air stream enters the condenser inlet.

2. The washer-dryer according to claim 1, wherein the at least one temperature sensor is arranged in proximity to the condenser inlet.

3. The washer-dryer according to claim 1, further comprising a heater, and at least one additional temperature sensor is arranged in proximity to the heater.

4. The washer-dryer according to claim 1, wherein the duct further comprises a partition wall, a septum or a bulkhead extending in the first direction and configured to protect the at least one temperature sensor from water drops.

5. The washer-dryer according to claim 4, wherein the partition wall, the septum or the bulkhead extends along a whole length of the duct.

6. The washer-dryer according to claim 4, wherein said partition wall, septum or bulkhead is made in a single piece construction with the rear wall of the washing tub.

7. The washer-dryer according to claim 4, wherein said partition wall, septum or bulkhead subdivides said duct into a lower region and into an upper region, the upper region containing said at least one temperature sensor.

8. The washer-dryer according to claim 1, wherein the sump is at a lowermost portion of the washing tub, and wherein at least one additional temperature sensor is located in the sump.

9. The washer-dryer according to claim 8, wherein a cylindrical curved wall of the laundry drum is perforated, so that the air stream from the laundry drum passes to the sump of the washing tub.

10. The washer-dryer according to claim 1, wherein the condenser and the rear wall of the washing tub are formed as a single body.

* * * * *